United States Patent [19]

Doty et al.

[11] Patent Number: 4,754,105

[45] Date of Patent: Jun. 28, 1988

[54] SEAT BELT BUCKLE WITH SWITCH

[75] Inventors: Gerald A. Doty, Crown Point, Ind.; James L. Zygutis, Frankfort, Ill.

[73] Assignee: Gateway Industries, Inc., Olympia Fields, Ill.

[21] Appl. No.: 45,902

[22] Filed: May 1, 1987

[51] Int. Cl.[4] ..... H01H 3/16

[52] U.S. Cl. ..... 200/61.58 B

[58] Field of Search ..... 200/61.58 R, 61.58 B

[56] References Cited

U.S. PATENT DOCUMENTS

| | | | |
|---|---|---|---|
| 3,833,781 | 9/1974 | Rumpf | 200/61.58 B |
| 3,956,603 | 5/1976 | Fisher | 200/61.58 B |
| 4,000,385 | 12/1976 | Colasanti | 200/61.58 B |
| 4,012,612 | 3/1977 | Loomba | 200/61.58 B |
| 4,015,094 | 3/1977 | Gavagan et al. | 200/61.58 B |
| 4,052,775 | 10/1977 | Gavagan et al. | 200/61.58 B X |
| 4,060,878 | 12/1977 | Dyki | 200/61.58 B |
| 4,163,128 | 7/1979 | Miskowicz | 200/61.58 B |
| 4,413,385 | 11/1983 | Gavagan et al. | 200/61.58 B X |
| 4,608,469 | 8/1986 | Doty | 200/61.58 B |

*Primary Examiner*—J. R. Scott

*Attorney, Agent, or Firm*—Fitch, Even, Tabin & Flannery

[57] ABSTRACT

Disclosed is a safety belt buckle including a switch which is preferably located between the buckle frame and a bottom cover of the buckle. An ejector for the tongue plate slides on a bottom web of the buckle frame and the ejector is displaced by entry of a tongue plate into the buckle frame. The ejector includes a portion projecting through an opening in the buckle base to a switch mounted in a cavity in the bottom cover and this portion engages a movable switch contact to open and close the switch.

14 Claims, 5 Drawing Sheets

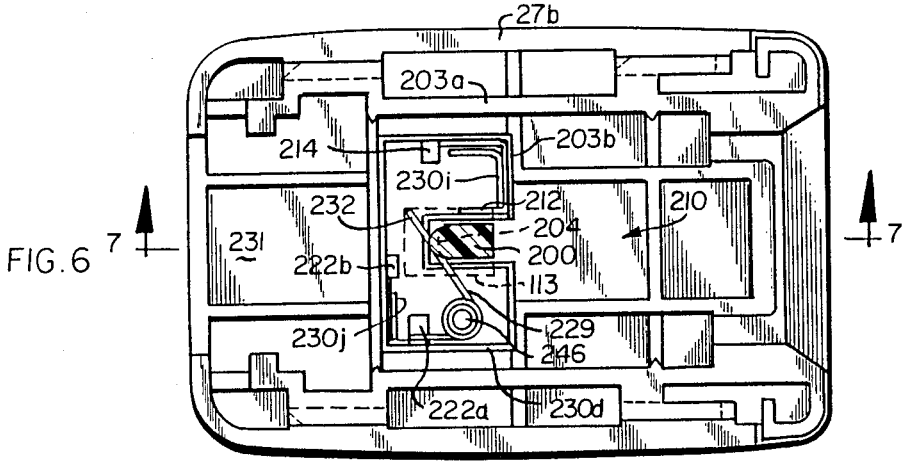
FIG. 6
FIG. 7
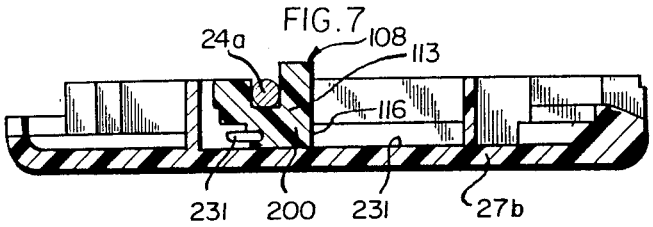
FIG. 8
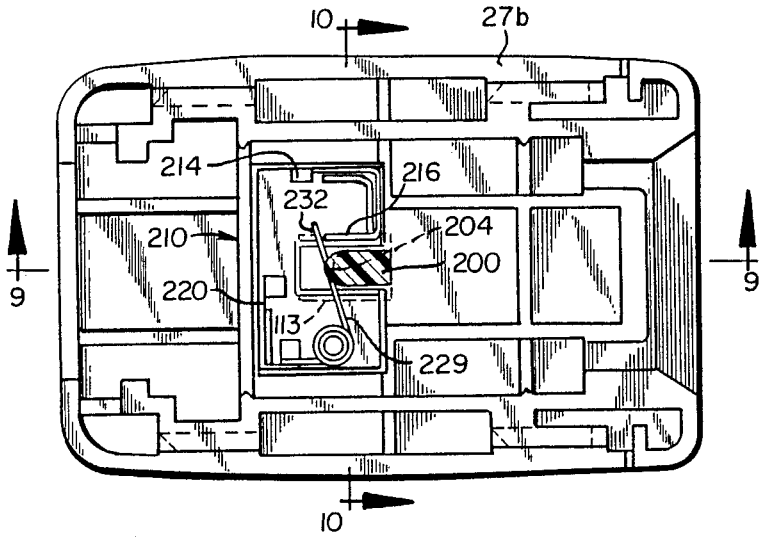
FIG. 9
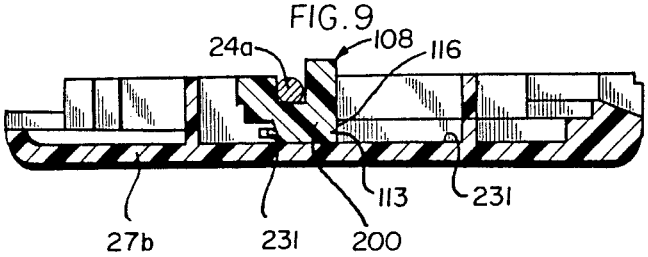

27a 72
74
89
90
73
89
82
82
66
62
66
46
18
84
85
78
70
71
86
71
63
46
57
112
77
24a
63
112
34
110
111
111
108
94
102
103
44
204
120
98
113,116
88
88
200
100
106
64
68a
68b
44
100
109
114
100
115
42
94
22
64
14
68b
42
231
40
36
38
12
27b
29
33b
38

SEAT BELT BUCKLE WITH SWITCH

BACKGROUND OF THE INVENTION

1. Field of the Invention

The present invention relates generally to seat belt buckles having an electrical switch therein to detect insertion of a tongue plate into a buckle frame.

2. Brief Description of Prior Art

It is well known for a seat belt buckle to include an electric switch which is actuated by insertion of a tongue plate. Such switches are used in conjunction with buzzers or other warning devices which sound when an occupant of an automobile has not buckled his seat belt. One such switch is described in U.S. Pat. No. 4,608,469 issued to Gerald A. Doty on Aug. 26, 1986, wherein the switch components are encased to form a separate, modular assembly which can be inserted in a variety of different seat belt buckles. A channelway extending from the encasing outer closure guides a reciprocating plunger which moves back and forth in the channelway. The plunger is generally L-shaped, having a first upstanding leg which engages the tongue plate. The second leg of the plunger is received in the channelway and has a bottom surface which slides back and forth on a floor of the channelway. The second leg has a stairstep arrangement with a short vertical riser portion between two horizontal steps. This vertical riser portion engages a moveable switch contact which comprises one arm of a coil spring. The step arrangement is necessary to prevent the spring arm from sliding under the plunger during switch actuation.

While having been met with general acceptance in the automotive industry, several improvements could be realized. The arrangement of U.S. Pat. No. 4,608,469 provided flexibility of use (owing to its modular drop-in design) but did not directly sense internal conditions of the seat belt buckle. That is, the switch was actuated solely by insertion of the tongue plate, and did not reflect a locked or latched condition directly indicative of seat belt protection where the tongue plate is not only fully inserted and latched by a pawl, but the pawl itself is locked against opening.

As indicated above, the switch of U.S. Pat. No. 4,608,469 does not respond directly to an operating condition of the seat belt buckle, but responds only to an insertion of a tongue plate. In general, it is desirable to ensure that a switch be operated only in response to the intended buckle operating condition. For instance, operation of the switch could be improved if a signal generated by the switch contacts were made to respond solely to the proper positioning of a mating tongue plate of particular configuration, rather than some other member introduced into the buckle. Further improvements could result if the switch were made to respond directly to a movement of a locking mechanism which takes place only when the tongue plate is locked to the buckle frame.

As described, the switch of U.S. Pat. No. 4,608,469 is adapted for use with a so-called "top-release" buckle where the push button for unlatching the buckle is operated in a direction transverse to the direction of tongue plate insertion. Frequently, especially in foreign markets, a "side-release" buckle is employed, where the push button for buckle release is operated in a direction parallel to that of the tongue plate insertion. Buckles of this type, to which embodiments of the present invention are directed, employ a lock pin or latch bar which is positioned to block release of a latching pawl from locking engagement with a tongue plate until the push button is operated. Usually, the lock pin or bar is mounted to slide in slots in the frame and is shifted by movement of the push button from a blocking position (blocking the latch pawl) to a release position (in which the latch pawl is free to pivot away from latching engagement with the tongue plate). In such buckles, the push button is typically biased toward an outer position and is pushed inward to unblock and open the latch mechanism.

One example of this type of seat belt buckle is given in copending U.S. patent application Ser. No. 045,954 filed May 1, 1987 entitled "Improved Seat Belt Buckle." The application discloses a seat belt buckle having a buckle frame and a pivotal latching member mounted therein which includes an improved actuating system for locking the latching member and for assisting in ejecting a tongue plate from the frame when the latch mechanism is in its open position. The actuating system includes a stirrup-like linkage having a cylindrical ejector portion with ends joined between a pair of pivotally mounted arms. A locking cylinder for locking the latching member also extends between the arms for travel in conjunction with the ejector portion. A generally U-shaped retainer includes flat plate-like walls which are pinned to the pair of arms. The ejector portion is snap-locked into a slider member for sliding reciprocation therewith during seat belt buckle operations. The slider member includes a sliding rail which reciprocates back and forth in the buckle frame.

The above-described seat belt buckle could be improved by providing a compact, lightweight reliable electrical switch which detects the insertion of a tongue plate into the buckle frame and which directly responds to a latching of the tongue plate as well as a locking of the latch member. In addition to low assembly and production costs, a commercially practical switch should be capable of operation over a period of several years without maintenance, while being subjected to such adverse environmental factors as dust, temperature extremes, and excessive humidity. In particular, the contacts of the switch, to meet automotive manufacturers' specifications, must be satisfactorily cycled thousands of times. A simple arrangement for wiping the contacts of the switch would help ensure reliable operation over several years of use.

SUMMARY OF THE INVENTION

Accordingly, it is a principal object of the present invention to provide a novel switch which may be installed in the above-described side release seat belt buckle as well as other buckles having a sliding member which is displaced upon insertion of a tongue plate.

It is another object of the present invention to provide a seat belt buckle switch which is capable of maintenance-free operation over a period of several years, and during several thousand cycles of operation.

Yet another object of the present invention is to provide a seat belt buckle sized for a compact space which is comprised of a minimum number of inexpensive parts and which provides a pair of contacts mating with a minimum mating force and having a wiping action which ensures continuous reliable operation in demanding environments, such as those encountered in operation of a motor vehicle.

These and other objects and features of the present invention, which will become apparent from the following detailed description and the accompanying drawings, are provided in a safety belt buckle including a buckle frame, and a bottom cover mounted beneath the buckle frame so as to form a switch-receiving cavity therewith. The buckle mates with a tongue plate having a tip for insertion into the buckle frame. Latch means carried by the buckle frame removably latch the tongue plate within the buckle frame. Actuator means carried by the buckle frame have a first portion engageable with the tongue plate tip for movement between first and second positions. A pair of switch contacts are located in the cavity, and one of the contacts is movable with respect to the other, between open and closed positions wherein electrical connection between the contacts is broken and established, respectively. The switch contacts are biased together so as to be normally closed. Actuator means having a second portion engageable with one switch contact move that one switch contact between closed and open positions as the actuator means is moved between its first and said second positions.

BRIEF DESCRIPTION OF THE DRAWINGS

In the drawings, wherein like elements are referenced alike,

FIGS. 6 and 8 are plan sectional views similar to that of FIG. 3 but showing the switch at different stages of operation;

FIGS. 7 and 9 are cross-sectional elevational views taken along the lines 7—7 and 9—9 of FIGS. 6 and 8, respectively;

DETAILED DESCRIPTION OF THE PREFERRED EMBODIMENT

Before proceeding with a description of the switch components, per se, a brief description of the seat belt buckle used to illustrate the switch of the present invention will be given. For a more detailed description of the buckle, see U.S. patent application Ser. No. 045,954, filed On the same day as this application, entitled "Improved Seat Belt Buckle", which is herein incorporated by reference.

In the following description, the buckle and its switch will be described in its illustrated orientation, and terms such as "upward" and "downward" will refer to directions relative to the illustrated orientation. It will be appreciated that this orientation has been selected merely for convenience of description, and that the buckle and switch may assume any of various different orientations during use.

Figure 10:
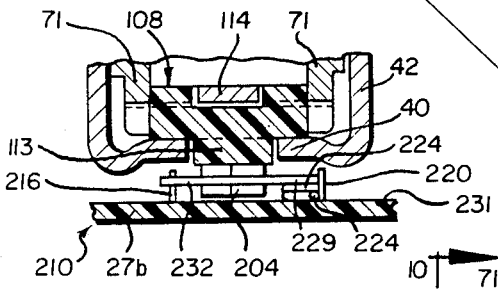
FIG. 10 is a partial, cross-sectional elevational view taken along the line 10—10 of FIGS. 2*a*, 2*b* and looking in the direction of the arrows.
Figure 2A:
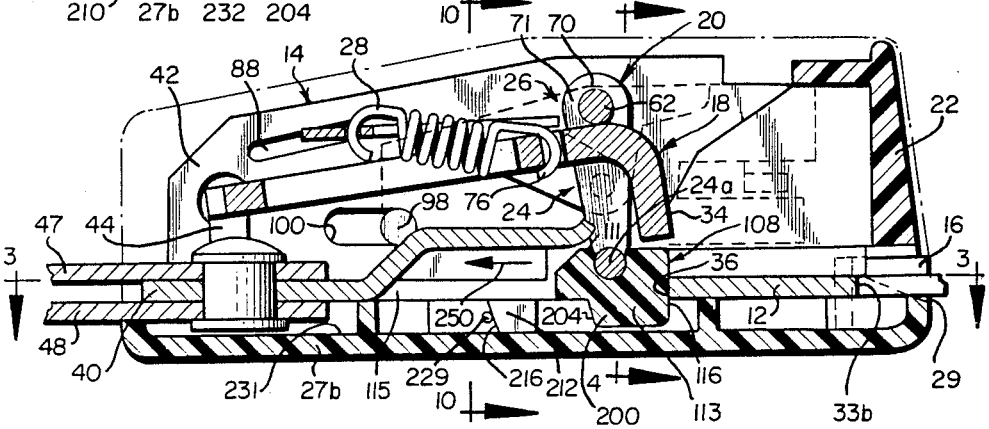
FIGS. 2*a* and 2*b* are longitudinal, sectional elevational views of the buckle of FIG. 1 at different stages of operation, and are taken substantially along line 2—2 of FIG. 1 and looking in the direction of the arrows.
Figure 2B:
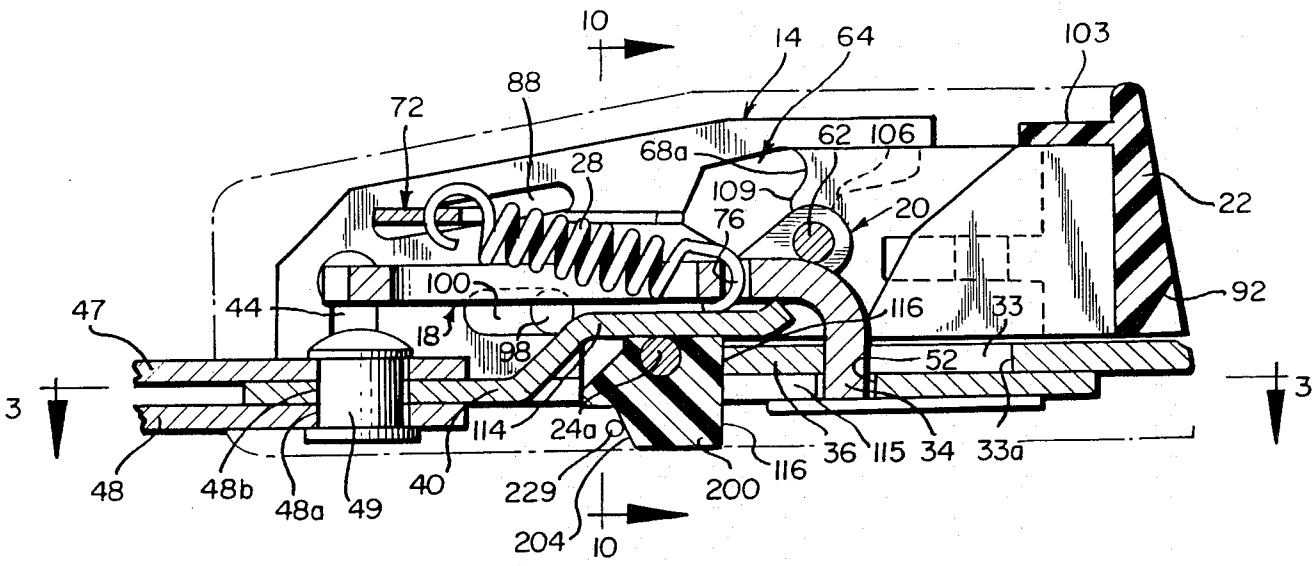

Referring initially to FIGS. 2*a*, 2*b* and 10, seat belt buckle 10 includes a tongue plate 12 and a buckle frame 14 having an opening 16 at its forward end for receiving the tongue plate 12. Mounted within the buckle frame is a pivotal latch or pawl 18 movable between a latching position for retaining the tongue plate 12 within the buckle frame 14 (see FIG. 2*b*) and an open position for enabling the tongue plate 12 to travel into and out of the buckle frame 14 (see FIG. 2*a*). The buckle 10 further includes a locking means 20 movable between a locked position for securing the pawl 18 in latching position and an unlocked position for enabling the pawl 18 to move between latching position and open position. A push button 22 shifts the pawl 18 from latching position to open position as the push button 22 is moved from a first, or outer position to a second, or inner position. Ejector means 24 urges the tongue plate 12 forwardly of the buckle 10 when the pawl 18 shifts to an open position. The movements of the various components are coordinated by actuator means 26.

The illustrated buckle 10 includes an exterior top cover 27*a* and a bottom cover 27*b*. The bottom cover 27*b* has a flared opening 29 at its forward end to receive the tongue plate 12, and as will be seen, houses the switch components.

The illustrated buckle, which is of the side release type, is capable of withstanding tensile loads of up to about 5000 lbs. and remains latched under such loads with a transverse locking member or pin 62 being positioned in blocking relationship to the pawl 18 when in latching position. The pawl 18 is so configured and positioned relative to the transverse member 62 that it is capable of withstanding these heavy loads despite its relatively small size and light weight.

A single spring 28 provides forward force to bias the push button 22 forward toward its outer position and an ejection force to urge the tongue plate 12 forwardly of the frame 14 when the pawl 18 is in open position. Spring 28 is a coil spring which is maintained in tension in an extended configuration. To avoid the possibility of the tongue plate 12 being retained within the buckle frame without the pawl 18 being locked in latching position, it is desirable that the locking means 20 automatically shift to a locked position after insertion of the tongue plate 12. To this end, the spring 28 additionally provides force to urge the locking means 20 toward its locked configuration after insertion of the tongue plate 12.

It will be appreciated that the pawl 18 must be held in an open position prior to insertion of the tongue plate 12 to enable insertion of the tongue plate 12. This is also accomplished in the illustrated embodiment by the spring 28. The spring 28 provides biasing force to maintain the pawl 18 in an open position when the locking means 20 is in its unlocked position.

Figure 1:
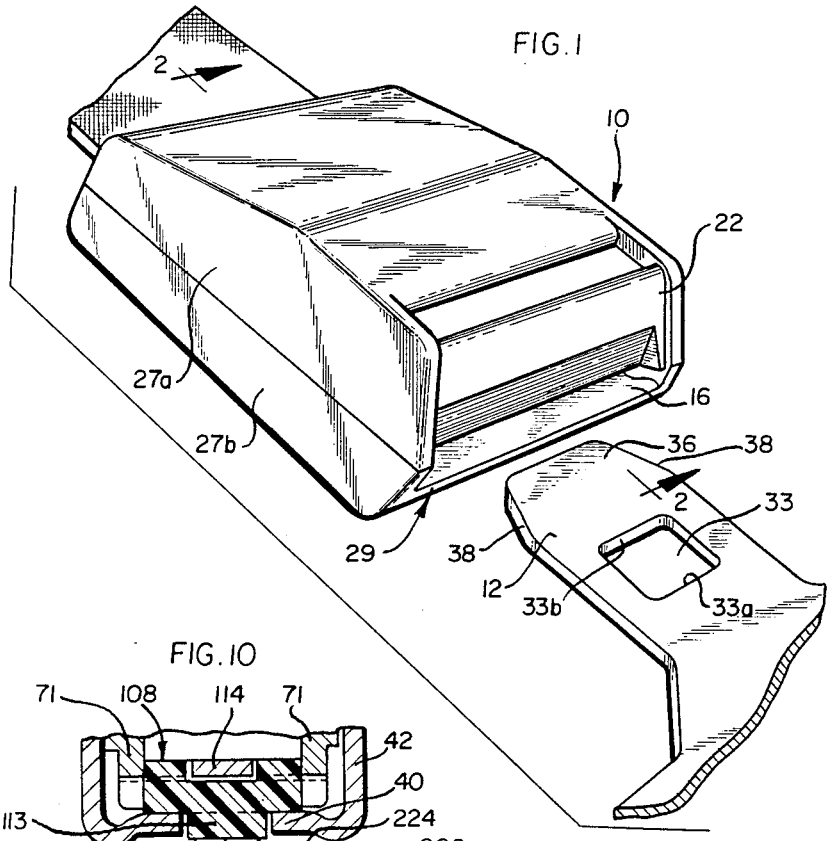
FIG. 1 is a perspective view of a seat belt buckle having a switch in accordance with the present invention.

Turning now to a more detailed description of the seat belt buckle, operating conditions to which the illustrated switch responds, will be described. Pawl 18 is pivotal between an upper or open position (FIG. 2*a*) and a lower or latching position (FIG. 2*b*). The illustrated switch, as will be seen, can be made to respond to the shift in latching and locking members occurring between these two positions. To retain the tongue plate 12 within the buckle frame, the pawl 18 includes a downwardly extending dog or tooth 34 at the forward end of the pawl 18, which is received in an opening 33 formed generally centrally through the tongue plate 12. The tongue plate 12 has a tapered leading end 36 with rounded corners 38 (FIG. 1) to facilitate its insertion into the buckle frame 14.

The buckle frame 14 herein includes a bottom wall 40 (which overlies the switch components) and a pair of upstanding side walls 42. To pivotally support the pawl 18 on the buckle frame 14, openings 44 are provided near the rear end of each side wall 42 to accommodate ears extending outwardly on opposite sides of the rearward end of the pawl 18. To secure the frame 14 of the buckle 10 to a support on the interior of a vehicle, means such as the illustrated straps 47 and 48 are provided. The straps 47 and 48 are preferably made of martensite steel to provide a high tensile strength member to resist the high tensile loads which may break similar members of ordinary steel.

The leading end 36 of the tongue plate 12 engages the ejector means 24 which, quite importantly, includes a slide block 108. The slide block 108 is journalled an ejector pin 24*a* as the leading end 36 is inserted into the buckle 10. The ejector pin 24*a* is an elongated cylindrical pin or member which extends across the width of the buckle frame 14.

The locking means 20 comprise a transverse member or locking pin 62 which extends across the top of the pawl 18, and a detent means 64 defining unlocked and locked positions for the transverse member 62. In the locked position, the detent means 64 constrain the locking pin 62 against upward movement, and the locking pin 62 constrains the pawl 18 against upward movement. The detent means in the illustrated embodiment comprise a pair of openings 64, one formed through each of the side walls 42 of the frame 14, which engage respective opposite ends 66 of the locking pin 62. Each opening defines a curved surface 68 against which the locking pin 62 is urged. The curved surface includes two adjacent curved detents 68*a* and 68*b* for the locked and unlocked positions, respectively.

To automatically shift the pawl 18 to latching position upon insertion of the tongue plate 12, the ejector means 24 is interconnected with the locking pin 62 by actuator means 26 which pull the locking pin 62 downwardly as the ejector means 24 is pushed rearwardly by the leading end 36 of the tongue plate 12 as the tongue plate 12 travels rearwardly into the buckle frame 14. This interconnection provides the actuation necessary for operation of the illustrated switch assembly, as will be explained. The actuator means 26 herein include stirrup-like linkage means 70 comprising a generally cylindrical central portion which comprises ejector pin 24*a*. The central portion extends between two link-shaped arms 71. Preferably, ejector pin 24*a* and arms 71 are integrally formed of die-cast metal, such as zinc.

The actuator means 26 further includes a three-walled, generally U-shaped retainer 72 which includes a generally flat plate containing an intermediate or bight portion 73. The flat plate is joined on opposite edges to flat plate-like side walls 84 which are pivotally connected to the linkage means 70. The flat plate also extends rearwardly from the arms 71 to the rearward end 74 of the spring 28. The forward end 76 of the spring 28 is curved into a generally hook-shaped configuration and is attached to the pawl 18 near its forward end. To facilitate this attachment, an opening 77 is provided in the pawl 18 near its forward end to receive the forward end 76 of the spring 28. A similar opening 90 is formed in bight portion 73 to receive the rearward end 74 of spring 28.

The locking pin 62 is preferably generally cylindrical so as to fit through generally circular apertures 78 near the upper ends of the respective link-shaped arms 71. The retainer 72 preferably has three integrally-formed walls including the bight portion or medial wall 73, legs 82 and flat plate-like depending side walls 84. Each side wall 84 has an aperture 85 for receiving outwardly-extending pivot connecting means or lugs 86 integrally formed with arms 71 of linkage means 70. To guide the retainer 72 as it travels, guide slots 88 are formed in the side walls 42 of the frame 14 and the bight portion 73 of the retainer 72 includes outward ears 89 which extend through the slots 88.

The buckle 10 is shown in FIG. 2*a* with the pawl 18 in open position for receiving the tongue plate 12. In the open position, the ejector means 24 is located below and slightly forward of the locking pin 62. In this position, the tension on the spring 28 acts through the retainer 72 to urge the linkage means 70, and in particular, block-like slide member 108, forwardly. The locking pin 62 is constrained against forward movement by the detent means 64 formed in the side walls 42 of the frame 14. Thus, the force exerted on the linkage means 70 by the retainer 72 tends to pivot the linkage means 70 in a counterclockwise direction, urging the ejector means 24 forward.

The push button 22 herein preferably has a front wall 92 which is generally smooth and attractive for engagement by the fingers of the user, a pair of side walls 94 extending rearwardly therefrom, and a camming means 106 for engagement with the ejection means 24 as described in further detail below. Each of the side walls 94 has an inwardly extending lug 98 formed on it to engage an elongated slot 100 in an adjacent side wall 42 of the buckle frame 14 to retain the push button on the frame. Additionally, each of the side walls 94 has a camming surface 102 formed on its inner surface for engaging the locking pin 62 as also described below.

A block-like switch actuator or slide member 108 is elongated in the direction of ejector means 24 and includes a pivot seat or trough 110 to receive the ejector pin 24*a*. Block 108 reduces the friction between ejector pin 24*a*, and arms 71 as the actuator means 26 reciprocates back and forth during seat belt buckle operation. Resilient retaining fingers 111 partially block an upper opening which provides access to trough 110 (see FIGS. 2*a*, 2*b* and 5). Fingers 111 are resiliently deflectable by ejector pin 24*a* as it is received in trough 110. The retaining fingers thereafter resume their normal relaxed configuration overlying ejector means 24 preventing its retraction from trough 110. There is thereby provided a snap-lock pivotal seating engagement between ejector member 24*a* and slide member 108.

Slide 108 further includes a forward face 116 for engaging the leading end 36 of tongue plate 12, and a central rail-like member 113 which is elongated in the direction of reciprocation of the ejector means during seat belt operation. Rail 113 is dimensioned to be received in the central elongated slot 115 formed in the bottom wall 40 of frame 14. As the ejector means 24 of stirrup-like linkage means 70 reciprocates in forward and rearward directions during seat belt operations, the cylindrical ejector member pivots or journals in trough 110.

Figure 4:
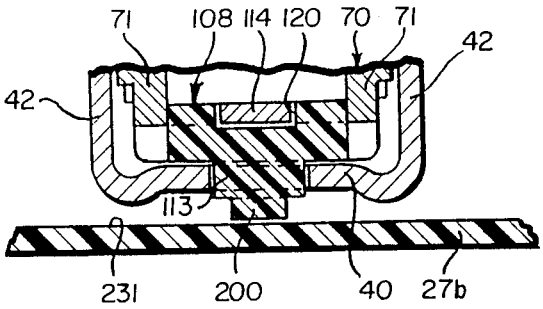
FIG. 4 is a partial sectional elevational view taken along the line 4—4 of FIG. 2*a* and looking in the direction of the arrows.

An additional feature of block member 108 is its tongue-receiving groove 120 generally coextensive with rail member 113, but located on the opposite, top side of the block member. Groove 120 receives a tongue or retaining finger 114 struck out of the bottom wall 40 of frame 14 to form slot 115. Tongue 114, in a close-fitting engagement with the groove 120 (see FIGS. 4 and 10), further controls any sideways displacement or misaligning torque experienced by block member 108, in addition to preventing an upward dislocation of ejector means 24 from slot 115. The upturned free end of tongue 114 engages the bottom surface of pawl 18 adjacent its forward end, as shown in FIG. 2*b* to provide a stop for the downward travel of pawl tooth 34.

A detailed description of the switch components will now be given. The switch components are illustrated in the perspective view of FIG. 5. An important feature of slide block 108 is the lower extension 200, formed on the underside of rail member 113. As indicated in the phantom lines of FIGS. 3, 6 and 8, the leading edge 204 of extension 200 resembles the bow of a boat, being tapered to a central leading edge which is vertically oriented and which is slanted from top to bottom, as seen most clearly in FIGS. 2*a*, 2*b*. Referring to FIGS. 2*a*, 2*b*, section lines 3—3 are cut through the rail member 113. Rather than show the rail member 113 in cross-section in FIGS. 3, 6 and 8, the outline of that member is shown in phantom so as not to obscure detail of the switch contacts located therebelow. Also, the outline of bow-shaped edge 204 is shown in phantom in FIGS. 3, 6 and 8, although it should be understood that this lower part of extension 200 lies below rail member 113. The advantages of showing rail member 113 and edge 204 in phantom in FIGS. 3, 6 and 8 will become apparent in the description of switch operation which follows shortly hereafter. As will be seen, as the seat belt buckle is operated, slide member 108 is advanced toward switch assembly 210 so as to bring the bow-shaped leading edge 204 into contact with a movable switch contact leg 229, the direction of this movement of slide member 108 being indicated by the arrow 250 in FIGS. 2*a*, 3 and 5.

Figure 5:
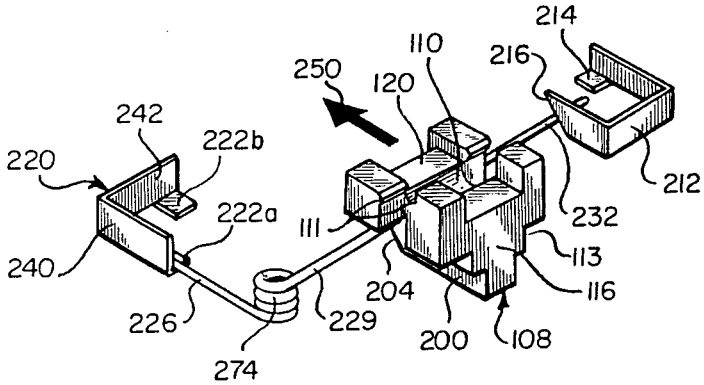
FIG. 5 is a partial perspective view showing the switch arrangement of the preceding figures in greater detail.
Figure 11:
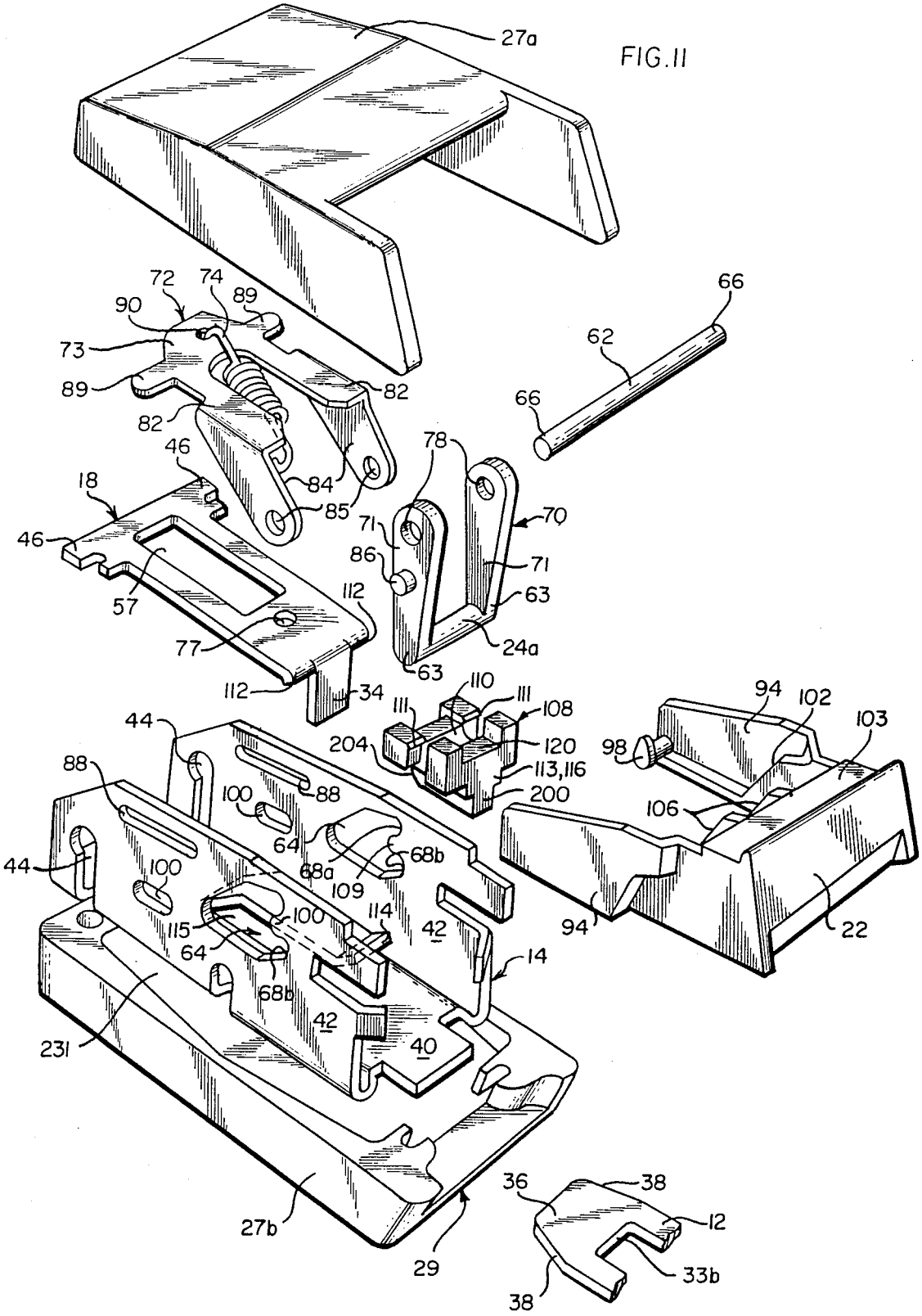
FIG. 11 is an exploded view of the seat belt buckle illustrated in the preceding figures.

Referring to FIG. 5, the switch arrangement is generally indicated at 210 and includes a first stationary metallic contact 212. The generally U-shaped contact 212 has a pad 214 at its first end for electrical connection to an external circuit, as by soldering to a wire conductor. The other end 216 of contact 212 is cut at an angle to form a beveled edge which electrically mates with the movable switch contact or leg 229. Switch arrangement 210 further includes a generally L-shaped second terminal 220 having a first leg 242 which provides soldered connection at pad 222*b* to an electrical conductor (not shown). The second leg 240 has a pad 222*a* for mating electrical connection with leg 226 of spring 224. The first horizontal portion 222*a* prevents the end of stationary spring leg 226 from passing under the leg 240 of terminal 220, and from digging into the bottom cover 27*b*. Due to the configuration of spring 224, leg 226 is biased into electrical engagement with pad 222*a*. An important feature of switch 210 is that the stationary leg 226 of spring 224 makes redundant contact with terminal 220 since it is cradled in the corner of the L-shaped cross section of the upstanding wall 240 of terminal 220 and pad 222*a*.

The first and second terminals, 212, 220, are preferably formed of relatively inexpensive soft bronze, but can also be made from phosphor bronze, copper, copper alloy or the like conductive material. Preferably, terminals 212, 220 are integrally formed by stamping a metallic sheet in a die which forms the terminals to the illustrated configurations.

A coil spring 224 has a first end portion 226 which overlies pad 222*a* of electrical terminal 220. A second, generally straight end of spring 224 forms the second, movable leg or contact 229 of the switch arrangement. The tip 232 of leg 229, which is free to move back and forth as coil spring 224 is coiled and uncoiled, contacts the beveled edge 216 of the first terminal 212, as indicated in FIGS. 2*a*, 5 and 10.

Figure 3:
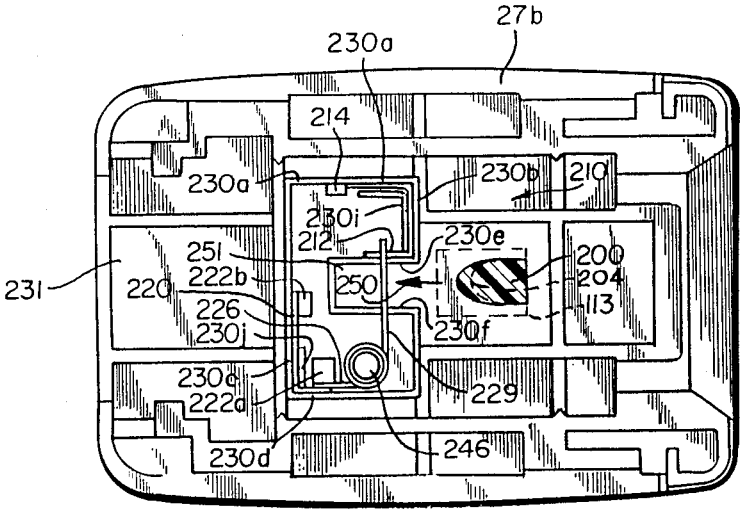
FIG. 3 is a sectional plan view of the buckle of FIG. 2 taken substantially along the line 3—3 of FIG. 2 and looking in the direction of the arrows.

Turning now to FIGS. 3, 6 and 9, installation of the switch components in the bottom cover 27*b* will be described. The numeral 230 is generally applied to a labyrinthian-like wall having continuous sections a–h, upstanding from the floor 231 of bottom cover 27*b*. In addition to continuous wall sections 230*a–h*, individual walls 230*i*, 230*j* are placed in the interior of bottom cover 27*b*. The first terminal 212 is snap fitted between the adjoining sections 230*a*, 230*b* of wall 230, and the generally L-shaped interior wall 230*i*. As such, terminal 212 is firmly positioned to withstand any forces during switch operation tending to displace or dislocate the terminal. In a similar manner, the second terminal 220 is snap fitted between adjoining outer wall portions 230*c*, 230*d*, and interior wall 230*j*. An upstanding post 246 telescopically receives the coils of spring 224. Due to the configuration of the legs and direction of winding of the coils of spring 224, the stationary leg 226 of the spring biases terminal 220 against wall portion 230*d*. This biasing, in addition to captivating of the adjoining end of terminal 220 between wall 230*j* and wall portion 230*d*, completely constrains terminal 220 from dislocation that may be experienced during operation of the switch. In addition, leg 226 is biased downwardly against pad 222*a*. Thus, it can be seen that the terminals, 212, 220 and the spring 224 of the switch assembly are secured to the bottom cover 27*b*.

Referring now to FIG. 5, tracing the electrical current path through switch assembly 210, and beginning at the left hand portion, electric current is introduced into the switch assembly through an external wire conductor (not shown) soldered to the outermost pad 222*b* of terminal 220. Current travels through terminal 220 to its other end 222*a* where it contacts the free end of stationary leg 226 of spring 224. Current travels through spring 224 to the tip 232 of its movable leg 229 which is biased against the beveled edge 216 of terminal 212. Current travels through this separable connection, passing through terminal 212 to solder pad 214, where it continues to an external circuit through a wire conductor (not shown).

As mentioned above, the configuration of the coils of spring 224 bias the tip 232 of movable leg 229 into engagement with the beveled edge 216 of terminal 212. During a contact make operation, when the circuit is closed between tip 232 and terminal 212, the spring force of spring 224 in addition to biasing the tip 232 into engagement with beveled edge 216, causes the tip to wipe or travel a relatively short distance along beveled edge 216. This provides a cleaning of the electrical engaging surfaces of the two mating switch parts 232, 216 which ensures a reliable electrical connection throughout many cycles of seat belt buckle operation, despite the usual contamination encountered in an automotive environment. The tapered leading edge 204 of extension 200 aids in this wiping action. With only three conductive components which are inexpensively produced and assembled in bottom cover 27*b*, a compact, rugged and highly reliable switch arrangement is provided.

As tongue plate 12 is inserted into the buckle frame, its leading end 36 contacts surface 116 of block 108. As the tongue plate is further inserted, block member 108 is advanced toward the left in FIGS. 2*a*, 2*b* and in the direction of arrow 250 in FIG. 5. Rail member 113 rides captive in slot 115 as the block member is pushed back and forth within the buckle frame. In FIGS. 2*a* and 3, the switch is illustrated in a closed position with the block member 108 located remote from movable spring arm 229. As the tongue plate is further inserted in the buckle frame, block 108 is further advanced in an inward direction, with extension 200 contacting movable leg 229 of spring 224. Upon continued movement, extension 200 deflects movable leg 229 against the bias force of spring 224, breaking electrical contact between the movable leg and terminal 212. FIGS. 6 and 7 show a full opening reflection of the movable spring arm 229 corresponding to a full inward travel of block member 108. As shown in FIGS. 3, 6 and 8, the labyrinthian walls 230*e*, 230*f* formed in bottom cover 27*b* form an axially extending channelway 251 (see FIG. 3) which receives extension 200. In the preferred embodiment, channelway 251 is dimensioned considerably larger than the width of extension 200, and is not relied upon to slidingly guide the extension 200, since adequate control over the movement of block 108 is provided in slot 115 of the frame floor 40, as described above. However, if desired, channelway 251 can be dimensioned to provide additional control over the movement of block member 108 with the sides of extension 200 engaging walls 230*e*, 230*f*.

Turning now to a brief description of the operation of the buckle of the preferred embodiment, when the tongue plate 12 is inserted into the buckle frame 14, its leading end 36 engages surface 116 of the guide block 108 and pushes guide block 108 which carries the ejector pin 24*a* rearwardly, pivoting the linkage means 70 clockwise in opposition to the biasing provided by the spring 28. As the ejector pin 24*a* is pushed rearwardly, and the top of linkage means 70 is urged forwardly by the spring force acting through the retainer 72, and the locking pin 62 is pulled downwardly along the curved surfaces 68 of defined by the detent means 64 formed in the side walls of the frame. As the locking pin 62 travels downwardly, it pushes the pawl 18 downwardly into the latching position wherein the pawl tooth 34 extends through the opening 33 in the tongue plate 12 and into the opening 52 in the bottom wall 40 of the frame 14. As the pawl 18 reaches its latching position, the locking pin 62 is moved into a locking position by the force of the spring 28 transmitted through the linkage means 70 and retainer 72.

Upon locking, the switch contacts of members 229, 212 are maintained in a broken or open circuit condition. Upon releasing the seat belt buckle, the occupant depresses push button 22 which, as explained above, initiates a sequence of movements which brings block-like member 108 in an outward direction as the tongue plate 12 is removed from the buckle frame. FIGS. 8 and 9 show the point of switch operation intermediate the full end points of travel of block member 108.

FIG. 6 shows the position of the switch components 229, 212 when tongue plate 12 is fully inserted in the buckle frame, with block 108 traveling a maximum inward amount. At this point in the cycle of seat belt buckle operation, tooth 34 is received in opening 33, being positioned adjacent the distal end 33*a* of the opening (see FIG. 1). As the user completes the locking operation and releases the tongue plate 12, the tooth 34 assumes a position adjacent the ventral edge 33*b* of opening 33 shown in FIG. 1. Accordingly, block 108 under the bias of spring 28 follows the leading end 36 of the buckle tip to assume the position indicated in FIGS. 8 and 9. Although the tension in switch spring 224 is relaxed, the tip 232 of movable leg 229 is not allowed to contact terminal 212. FIGS. 8 and 9 show the seat belt buckle in its normal, fully locked position. With removal of the seat belt buckle, as explained before, the switch is closed, upon assuming the position of FIGS. 2*a* and 3.

To open the pawl 18 and permit withdrawal of the tongue plate 12, the push button 22 is pushed inwardly, displacing the locking pin 62 rearwardly to the point 109 where it is no longer constrained against upward movement by the detent means 64. This displacement is accomplished by the engagement of the camming surfaces 102 on the push button 22 with the opposite ends 66 of the locking pin 62. In addition, the push button camming means 106 has a pair of camming surfaces which engage shoulders 112 on the pawl 18 to push it upwardly as the push button 22 is pushed inwardly. Once the locking pin 62 has traveled upward beyond the point 109, it is urged by the spring force into the detent 68*a* corresponding to the unlocked position. When the pawl 18 is in the open position of FIG. 2*a*, the tongue plate 12 is free to move outwardly, out of the buckle frame 14. To eject the tongue plate 12 in this direction, the leading surface 116 of block member 108 engages the leading end 36 of the tongue plate 12 (as shown in FIG. 2*b*) and ejects the tongue plate from the buckle as the slide block travels forwardly to the position shown in FIG. 2*a*. As the ejector means 24 travels forwardly, slide block 108 engages the surfaces of camming means 106 on the push button 22 to return the push button 22 to its outer position. As mentioned before, the switch contacts 216, 229 close during this operation. The tapered edge 204 of extension 200 aids in providing a smooth separation of spring arm 229 from block member 108.

As can now be appreciated, the integrity of the signals generated by the switching arrangement 210 of the illustrated embodiment is significantly improved. The sliding block 108, which engages the movable switch contact, is directly linked to and is therefore constrained to follow only the disposition of the locking, latching and ejector means of the seat belt buckle. Further, the switch cannot be operated by inserting an unintended object such as a screwdriver or the like, since the tooth 34 of pawl 18 would be prohibited from moving into the position of FIG. 2*b*. Further, it is specifically contemplated in the present invention that the relative spacing and configuration of the switch components be such that the circuit is opened only when the pawl is in a fully locked condition, and that the fully locked condition is possible only when the configured tongue plate is fully inserted in the buckle. For example, the illustrated embodiment shows a tongue plate 12 having the critical dimension between its leading end 36 and the edge 33*b* of its opening 33. With reference to FIG. 2*b*, a shorter dimension will allow the tongue plate 12 to travel toward the right, being partially extracted from the seat belt buckle, and allowing the switch components to change state, i.e., assume a closed circuit condition (illustrated as an unlatched condition of the buckle.) Conversely, if the dimension between leading end 36 and edge 33*b* is too great, (i.e., an improperly configured object is inserted in the buckle) an opening necessary to receive the tooth 34 of pawl 18 is partially blocked, prohibiting the pawl from assuming a locked condition which in turn would prevent swinging movement of the linkage which permits sliding block 108 to travel the necessary extent. That is, the link arms 71 would not be allowed to tilt sufficiently to allow ejector cylinder 24*a* the necessary travel in direction 250. In effect, the seat belt buckle will reach a stable state, with the tongue plate pressing against block 108 which, through its connection with the linkage with the ejector and locking mechanism, drives the leading end of tooth 34 against the leading portion of the tongue which blocks the downward travel necessary to assume the position of FIG. 2*b*. Only a properly configured tongue plate will allow the cycle of switch operation to be completed.

Further, it will be appreciated that the switch components illustrated herein could be positioned to provide a closed circuit upon plate insertion and an open circuit when the tongue plate is disconnected from the seat belt buckle.

While a preferred embodiment of the invention has been illustrated and described above, there is no intent to limit the scope of the invention to this or any other specific embodiment. The scope of the invention is defined by the spirit and language of the appended claims.

What is claimed is:

1. In a safety belt buckle, the combination comprising:

a buckle frame having a central web with an opening in the web;

a bottom cover mounted beneath the web of the buckle frame and forming a switch-receiving cavity therewith;

a tongue plate having a tip for insertion into the buckle frame and for sliding along the central web;

latch means carried by said buckle frame for removably latching the tongue plate within the buckle frame;

switch means including switch contacts in said cavity, one of said contacts movable with respect to the other between open and closed positions wherein electrical connection between the contacts is broken and established, respectively;

an ejector slidably mounted in said buckle frame to slide on said central web and over said opening;

switch actuator means operable by said ejector to move said switch contacts between at least one of said open and closed positions;

and a projection on said switch actuator means extending through said opening from said ejector to said switch means in said cavity in said bottom cover.

2. The combination of claim 1, wherein said projection on said actuator means is an integral portion of the ejector.

3. The combination of claim 2 further comprising:

a push button movable between a first position and a second position and operatively associated with the latch means to shift the latch means from a latching position to an open, unlatching position when the push button is moved from the first position to the second position; and a biasing means for biasing the push button toward its first position and for urging the tongue plate forwardly of the buckle frame upon movement of said latch means from said latching position to said open position, said biasing means including a first portion connected to the latch means to pull the latch means to its open position.

4. The combination of claim 3 further comprising:

a linkage means connected between the ejector and the biasing means for applying an urging force to said ejector, said ejector contacting the tongue plate for urging the tongue plate to slide outwardly from the buckle frame.

5. The combination of claim 4 wherein said ejector includes a rail-like portion and said opening in a slot to slidably receive said rail-like portion, and said projection depends from said rail-like portion to project into said switch-receiving cavity.

6. The combination of claim 5 wherein said projection has an inclined leading surface for engaging said one switch contact.

7. In a safety belt buckle, the combination comprising:

a buckle frame;

a tongue plate having a tip for insertion into the buckle frame;

latch means actuatable movable from a release position to a latching position to removably latch the tongue plate within the buckle frame;

a bottom cover mounted beneath the buckle frame;

an ejector engageable with said tongue plate tip and biased to eject the tongue plate tip from the buckle frame;

a pair of switch contacts in said bottom cover, one of said contacts movable with respect to the other between open and closed positions wherein electrical connection between the contacts is broken and established, respectively;

latch operating means movable by said tongue plate tip to shift said latch means between said released and said latching positions;

said ejector connected to said latch operating means and engage by said tongue plate and movable thereby;

biasing means for biasing said switch contacts to one of said positions; and said latch operating means engageable with said ejector to move said one switch contact to one of said closed and said open positions as said latch means is actuated to removably latch the tongue plate in the buckle frame.

8. The combination of claim 7, further comprising:

locking means movable to a locking position to lock the latch means in a latched condition; and said latch operating means operable to move said locking means to said locking position as said one switch contact is moved to one of said closed and said open positions as said latch means is actuated to removably latch the tongue plate in the buckle frame and as said locking means is actuated to lock the latch means.

9. The combination of claim 8, wherein said switch actuating means is slidably mounted with respect to said frame.

10. The combination of claim 9 further comprising:

a push button movable between a first position and a second position and operatively associated with the latch means to shift the latch means from latching position to open position when the push button is moved from the first position to the second position; and a biasing means for biasing the push button toward its first position and for urging the tongue plate forwardly toward the buckle frame upon movement of said latch means from latching position to open position, said biasing means including a first portion connected to the latch means to pull the latch means to its open position.

11. The combination of claim 10 further comprising:

said latch operating means including a linkage means mounted on said frame and connected to the locking means.

12. The combination of claim 9 wherein said switch actuating means includes a rail-like portion and said frame includes a bottom wall slotted to slidably receive said rail-like portion, said rail-like portion projecting into said cavity to engage said one switch contact.

13. The combination of claim 12 wherein said rail-like portion has an inclined leading surface for engaging said one switch contact.

14. In a safety belt buckle, the combination comprising:

a tongue plate;

a buckle frame for receiving the tongue plate;

pivotal latching means movable between a latching position for retaining the tongue plate within the buckle frame and an open position for enabling the tongue plate to travel into and out of the buckle frame;

locking means movable between a locked configuration for locking the latching means in its latching position and an unlocked configuration for enabling the latching means to move between its latching position and its open position;

a push button movable between a first position and a second position and operatively associated with the latching means to shift the latching means from latching position to open position when the push button is moved from the first position to the second position;

a biasing means for biasing the push button toward its first position and for at least partially ejecting the tongue plate from the buckle frame upon movement of said latching means from latching position to open position, said biasing means including a first portion connected to the latching means to pull the latching means to its open position;

a linkage means including an ejector slide mounted on said frame and engageable with said tongue plate, said linkage means connected between the biasing means and the locking means;

a rearward portion of said biasing means connected to said linkage means to pull the latter and the locking means forwardly to shift the locking means into locking position;

a bottom cover mounted beneath the buckle frame;

a pair of switch contacts in said bottom cover, one of said contacts movable with respect to the other between open and closed positions where electrical connection with the other contact is broken and established, respectively; and said ejector slide engageable with said one switch contact to move said one switch contact between said closed and said open positions.

* * * * *

UNITED STATES PATENT AND TRADEMARK OFFICE

CERTIFICATE OF CORRECTION

PATENT NO. : 4,754,105

DATED : June 28, 1988

INVENTOR(S) : Gerald A. Doty and James L. Zygutis

It is certified that error appears in the above-identified patent and that said Letters Patent is hereby corrected as shown below:

Column 5, Line 35, after "means" insert --64--;

Column 5, Line 36, after "openings" delete "64";

Column 7, Line 39, after "contact" insert --or--; (2nd occurrence)

Column 7, Line 63, delete "upstanding wall" and substitute --leg-

Signed and Sealed this

Twenty-ninth Day of November, 1988

*Attest:*

DONALD J. QUIGG

*Attesting Officer*

*Commissioner of Patents and Trademarks*